US006505920B1

(12) United States Patent
Braun

(10) Patent No.: US 6,505,920 B1
(45) Date of Patent: Jan. 14, 2003

(54) SYNCHRONOUSLY STIMULATED CONTINUOUS INK JET HEAD

(75) Inventor: Hilarion Braun, Gilbert, AR (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/335,015

(22) Filed: Jun. 17, 1999

(51) Int. Cl.[7] ..... B41J 2/02
(52) U.S. Cl. ..... 347/75; 347/68
(58) Field of Search ..... 347/75, 20, 11, 347/68, 69, 70

(56) References Cited

U.S. PATENT DOCUMENTS 4,584,590 A * 4/1986 Fischbeck et al. ..... 347/69
4,825,227 A * 4/1989 Fischbeck et al. ..... 347/69
4,937,589 A * 6/1990 Fagerquist et al. ..... 347/75
5,598,196 A * 1/1997 Braun ..... 347/68
5,713,916 A * 2/1998 Dias ..... 606/69
5,736,994 A * 4/1998 Takahashi ..... 347/11
6,033,059 A * 3/2000 Wen et al. ..... 347/71

* cited by examiner

*Primary Examiner*—Shih-wen Hsieh
(74) *Attorney, Agent, or Firm*—Barbara Joan Haushalter

(57) ABSTRACT

An ink jet print head for a continuous ink jet printer includes an orifice plate defining an elongated array of ink jet orifices, an ink manifold for supplying ink to the orifices in the orifice plate, and a shear mode piezoelectric transducer mechanically coupled to the orifice plate for vibrating the orifice plate sufficiently uniformly along the length of the array of ink jet orifices to achieve synchronous stimulation. The use of a shear mode piezoelectric transducer eliminates mode cross coupling thereby allowing high frequency stimulation in long ink jet print heads.

7 Claims, 8 Drawing Sheets

SYNCHRONOUSLY STIMULATED CONTINUOUS INK JET HEAD

TECHNICAL FIELD

The present invention relates to continuous ink jet printers and more particularly to improved constructions for stimulating synchronous drop break-up of the ink jets issuing from elongated arrays of orifices in such printers.

BACKGROUND ART

In continuous ink jet printing, ink is supplied under pressure to a manifold that distributes the ink to a plurality of orifices, typically arranged in linear array(s). The ink is expelled from the orifices in jets which break up due to surface tension in the ink into droplet streams. Ink jet printing is accomplished with these droplet streams by selectively charging and deflecting some droplets from their normal trajectories. The deflected or undeflected droplets are caught and re-circulated and the others are allowed to impinge on a printing surface.

To selectively charge the ink droplets, it is desirable to stimulate the ink jets to accurately control the locations that the droplets separate from the ink jets downstream from the orifice plate. Such stimulation is provided by applying a vibration to the ink, for example, by vibrating the orifice plate. Stimulation also maintains uniform drop size and drop spacing as well as controlling the location of drop separation. It is also desirable that the droplets in all of the jets separate at the same time from their respective jets, this is called synchronous stimulation. Such synchronous stimulation simplifies the problem of drop charging, since each drop in each jet separates from the jet at a precisely predictable time period allowing accurate drop charging and placement and avoiding printing errors due to improper droplet charging.

Synchronous stimulation of an array of ink jets at high frequency (e.g., above 40 kHz) is difficult when the array length is greater than ½ $\lambda$, where $\lambda$ is the wavelength of an acoustic wave at the stimulation frequency $f_0$. For a bulk acoustic wave, the wavelength is given by $\lambda=C_B/f$, where $C_B$ is the bulk velocity of sound given by $C_B=\sqrt{B/P}$ where B is the bulk modulus of the material and P is the density of the material. For stainless steel, which is a currently favored material for synchronously stimulated continuous ink jet print heads, $C_B$ is about 5,000–6,000 m/sec, resulting in $\lambda\approx 11$ cm at 50 kHz. Thus, for ink jet arrays longer than about 5 cm, it is difficult to achieve synchronous stimulation. This is so because the print head can vibrate in many different modes which are a function of its size.

As the physical dimensions of a print head increase, the number of vibrational modes increases, the relative frequency difference between the vibrational modes decreases and the modes become crowded in the operational frequency range of the print head. When there are vibrational modes in the print head that have a frequency close to the desired stimulation frequency, a phenomenon called mode coupling occurs and energy delivered to the print head to vibrate the print head in a desired mode to stimulate the ink jets causes the print head to be excited in other undesirable modes, thereby dispersing the stimulating energy, and disrupting the synchronous stimulation of the jets. For example, to operate a print head having an array of orifices ½ cm in length at 50 kHz the print head may be shaped such that its length perpendicular to the array is ½ $\lambda$ (about 5 cm) and its other dimensions are as small as possible. With this shape (long in the direction parallel to the ink jets) the print head has very few other vibrational modes near 50 kHz and hence mode coupling does not occur. A print head of this type is shown in U.S. Pat. No. 4,683,477 issued Jul. 28, 1987 to Braun, et al.

When the orifice array is made larger, for example, 10 cm, the print head has many other modes near 50 kHz which must be suppressed for proper operation of the print head. U.S. Pat. No. 4,999,647 issued Mar. 12, 1991 to Wood, et al, discloses an ink jet print head having a series of slots through the print head body to divide the body into a plurality of approximately identical dilatational regions. These slots have the effect of decreasing the mode coupling between the desired vibrational mode necessary for synchronous stimulation and undesired modes that decrease efficiency and frustrate synchronous stimulation. As printing speeds are increased, it becomes desirable to stimulate the ink jets at increasingly higher frequencies. It has been found, however, that print heads of the type shown in the '647 patent cannot be synchronously stimulated much above 100 kHz before mode coupling again becomes a serious problem. At such high frequencies, the problem of mode coupling is compounded by the driving action of the drive crystals. When excited by the electric field, the piezoelectric transducers modulate in both the length and width directions. Hence, the piezoelectric transducers can excite vibration in not only the desired direction but also in the perpendicular direction. As a result, they couple into undesirable vibration mode.

A need has therefore been identified for a print head for a continuous ink jet printer which can be synchronously stimulated above 100 kHz.

SUMMARY OF THE INVENTION

It is the object of the present invention to provide a print head for a continuous ink jet printer that can be synchronously stimulated at frequencies above 100 kHz. It is another object to provide a print head that exhibits reduced mode coupling during stimulation.

The objects are achieved according to the present invention by stimulating an orifice plate defining an elongated array of orifices in a continuous ink jet print head with a shear mode piezoelectric transducer. Since a piezoelectric transducer does not exhibit substantial vibrational mode coupling when driven in a shear mode, the problems noted above with respect to the prior art are solved. For example, a piezoelectric ceramic crystal cut to a length of 7.5 cm with a 0.6 cm×0.48 cm cross-section driven in a shear mode has a resonance near 200 kHz with its second harmonic at or near 400 kHz without any other resonances in that range. In contrast, when operated in its thickness mode, the same crystal will couple into vibrations at a very large number of dilatational and bending modes in the range of frequencies between 200 and 400 kHz. The advantage achieved by the present invention is the ability to operate a long (greater than several centimeters) ink jet print head at frequencies greater than 100 kHz.

Other objects and advantages of the invention will be apparent from the following description and the appended claims.

DETAILED DESCRIPTION OF THE INVENTION

Figures 1, 2A:
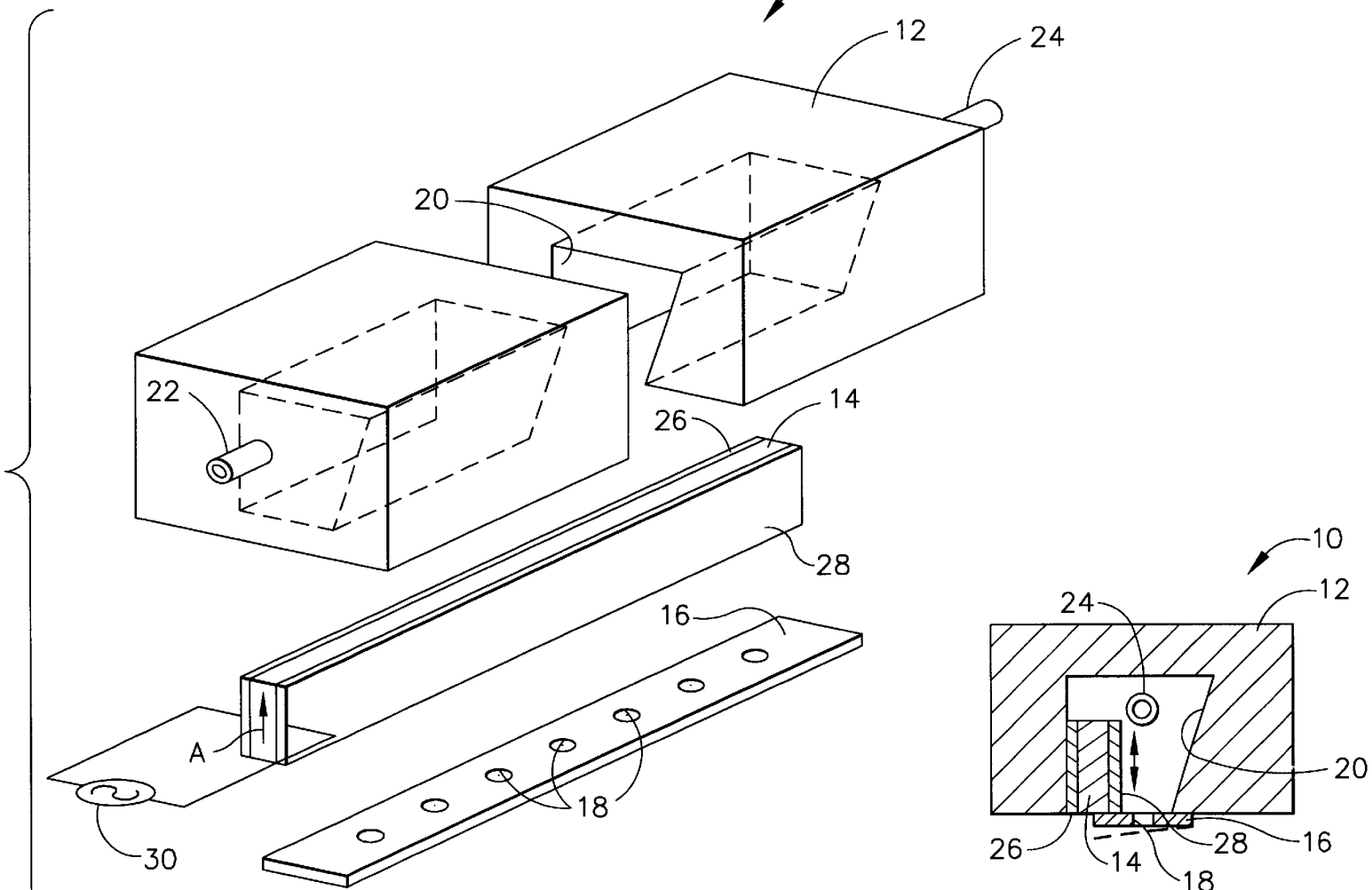
FIG. 1 is an exploded perspective, partially broken away, view showing an ink jet print head according to the present invention.
FIG. 2A is a cross-sectional view of the ink jet print head shown in FIG. 1.

Referring to FIG. 1, an ink jet print head according to the present invention is generally designated 10. It will be understood that the print head 10 cooperates with other known components in an ink jet printer, such as drop charging and deflection electrodes, a drop catcher and ink recirculation system (not shown). Ink jet print head 10 functions to produce the desired streams of uniformly sized and spaced ink droplets in a highly synchronous manner. The ink jet print head 10 is constructed to provide synchronous droplet streams in a long array printer of very high stimulation frequencies and includes a manifold body 12, a shear mode piezoelectric transducer 14, and an orifice plate 16 defining an elongated array of ink jet orifices 18.

Manifold body 12 is constructed of a rigid material such as stainless steel and defines a longitudinal cavity 20 for conducting ink to the orifice plate 16. A pair of ink supply tubes 22, 24 communicate with cavity 20 to supply ink from an external ink supply (not shown). Shear mode piezoelectric transducer 14 is provided with a pair of electrodes 26, 28 connected to an alternating electrical energy source 30 which applies a varying voltage across the piezoelectric transducer 14. Piezoelectric transducer 14 is poled in the direction indicated by arrow A such that when a voltage is applied across electrodes 26, 28, the transducer deforms in a shear mode.

Figure 2B:
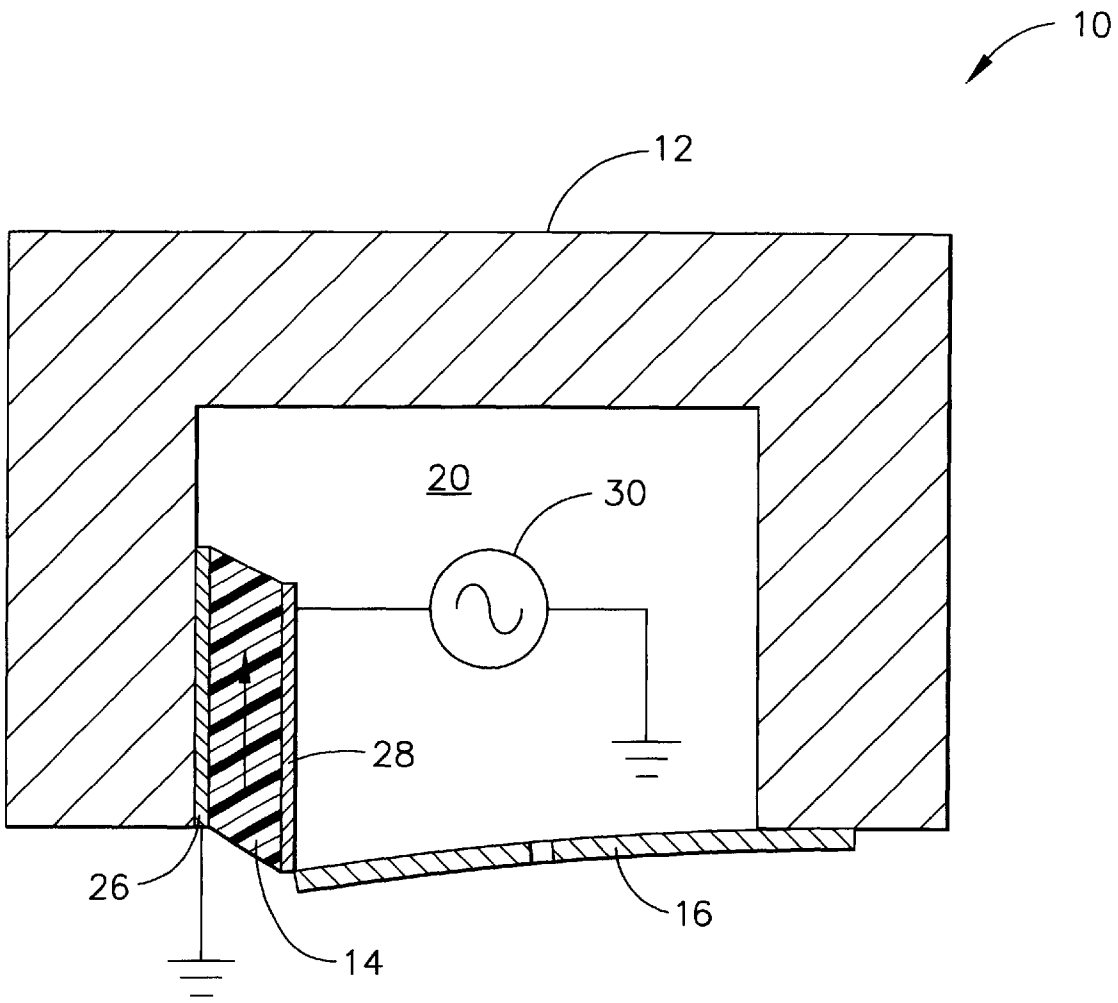
FIG. 2B is a simplified illustration of FIG. 2A.

As shown in FIGS. 2A and 2B, piezoelectric transducer 14 is bonded to an inside wall of cavity 20 and orifice plate 16 is bonded along one edge to manifold body 12 and along the opposite edge to piezoelectric transducer 14. As varying voltage is applied to piezoelectric transducer 14, it physically distorts in a shear mode to slightly displace the edge of the orifice plate 16, as shown by the dotted line in FIG. 2A.

In operation, ink is pumped into the print head 10 through supply tube 22 and is expelled under pressure from orifices 18 to form ink jets. The orifice plate 16 is stimulated by applying a variable voltage at a frequency of 100 kHz or greater between the electrodes 26 and 28, of piezoelectric transducer 14 thereby causing the ink jets to synchronously break up into droplets.

Since the shear mode piezoelectric transducer 14 does not exhibit significant cross coupling into other vibrational modes, synchronous stimulation at frequencies higher than 100 kHz is readily achieved with this arrangement. An operating ink jet print head according to the present invention can therefore be constructed with a manifold body 12, 4 cm long×1.5 cm wide×1.5 cm high being fabricated from stainless steel. A piezoelectric ceramic transducer 14, 3.0 cm long×0.63 cm wide×0.21 cm thick, is poled in the direction indicated by arrow A in FIG. 1. Stainless steel and copper electrodes 26, 28 can be applied, such as by sputtering. The transducer 14 can then be bonded inside the cavity 28 defined by the manifold body 12, using suitable means such as epoxy. An orifice plate fabricated of bright nickel as described in U.S. Pat. No. 4,184,925 and having an array of 240 25 $\mu$m diameter orifices spaced at 100 $\mu$m centers can be bonded to the bottom of the manifold body by epoxy. Electrical connections can be made to the electrodes by soldering. An alternating voltage of 5 volts at 10 kHz–200 kHz may be applied to the electrodes while ink is supplied to the print head.

Since the ink employed in the continuous ink jet head 10 is conductive, provision is made to insulate the electrodes 26 and 28 from the ink to avoid electrolysis of the ink and/or shorting of the electrical energy source 30. The electrode may be protected from the ink by covering it with a suitable insulating coating such as epoxy.

In a typical piezoelectric actuator, the poling axis of the material is directed from one electrode to the other. Such a configuration is a thickness mode actuator. When the voltage is applied between the electrodes, the thickness of the piezoelectric will change. The change in the thickness is accompanied by a change in the length and the width of the actuator as a result of the Poisson's ratio of the material. When bonded onto a drop generator or other object, the change in length produced by a voltage across the electrodes can cause the drop generator to expand or flex. An ac drive voltage across the piezoelectric can cause the drop generator to vibrate. Unfortunately, in the thickness mode piezoelectric actuators, the ac voltage not only modulates the length of the piezoelectric but also the width. As a result, vibrational modes oriented not only along the length but also the width can be excited by such actuators. Such actuators can therefore excite not only the modes desired for stimulation of the jet array, but also modes which produce nonuniform stimulation.

A different configuration of piezoelectric actuator can avoid this problem. In shear mode piezoelectric actuators, the poling axis of the material is oriented parallel to the plane of the electrodes, not perpendicular as in the thickness mode. When a voltage is applied across the electrodes, shearing forces are produced in the material to cause the material to deform, with the material assuming a parallelogram shape. The shear mode poled piezoelectric material motion is transferred to the orifice plate, to cause sufficient vibration to form print drops. This shearing action is not accompanied by any changes in the length or width of the actuator. When such an actuator is driven by an ac voltage, the shearing action produces a vibration in the one direction. As the length and width of the piezoelectric are unaffected by the shearing action, the shear mode actuators have no tendency to induce vibrations in other directions.

In FIGS. 2A and 2B, the orifice plate and the shear mode piezoelectric are attached to the fluid manifold. The fluid manifold is designed to be rigid so that it is not induced to vibrate in any of its vibrational modes. It may be ultrasonically damped to help keep it from vibrating. As the left electrode face of the piezoelectric is secured to the rigid fluid manifold, when the piezoelectric is driven by an ac voltage between the two vertical electrode faces the right electrode face of the piezoelectric is caused to vibrate vertically. As the orifice plate is attached to the inner or right lower corner of the piezoelectric, the orifice plate is vibrated as well. As the vibration was produced without the need to induce compression or tension of the parts, there is no Poisson ratio induced coupling to produce a distortion or vibration in the direction perpendicular to the paper. Therefore, by placing the piezoelectric such that the poling axis and the electrode faces are perpendicular to the orifice plate and attaching the orifice plate to one electrode face and the fluid manifold to the other one, the desired vibration of the orifice plate parallel to the direction of the jets (not shown) can be produced without any tendency to produce distortions or vibrations down the length of the array.

Figure 3:
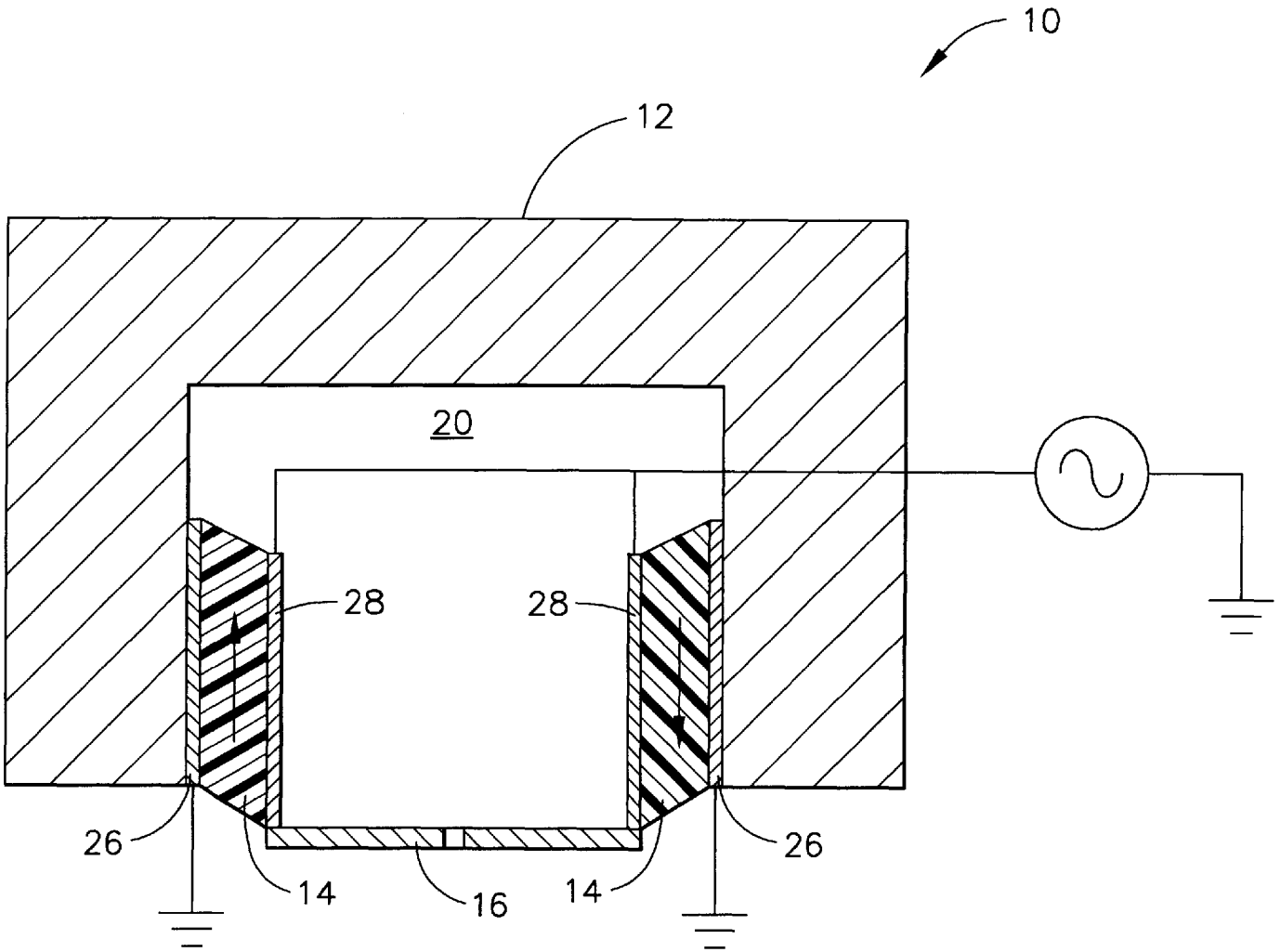
FIGS. 3–8 are additional alternative embodiments of a print head constructed in accordance with the teachings of the present invention.

A similar structure is shown in FIG. 3. Instead of attaching one side of the orifice plate to the fluid manifold, it is attached to a second piezoelectric, so that a piezoelectric is on both sides of the orifice plate 16. Both piezoelectrics 28 are driven by a single oscillator. The outer piezoelectrics 26 are grounded.

Figure 4:
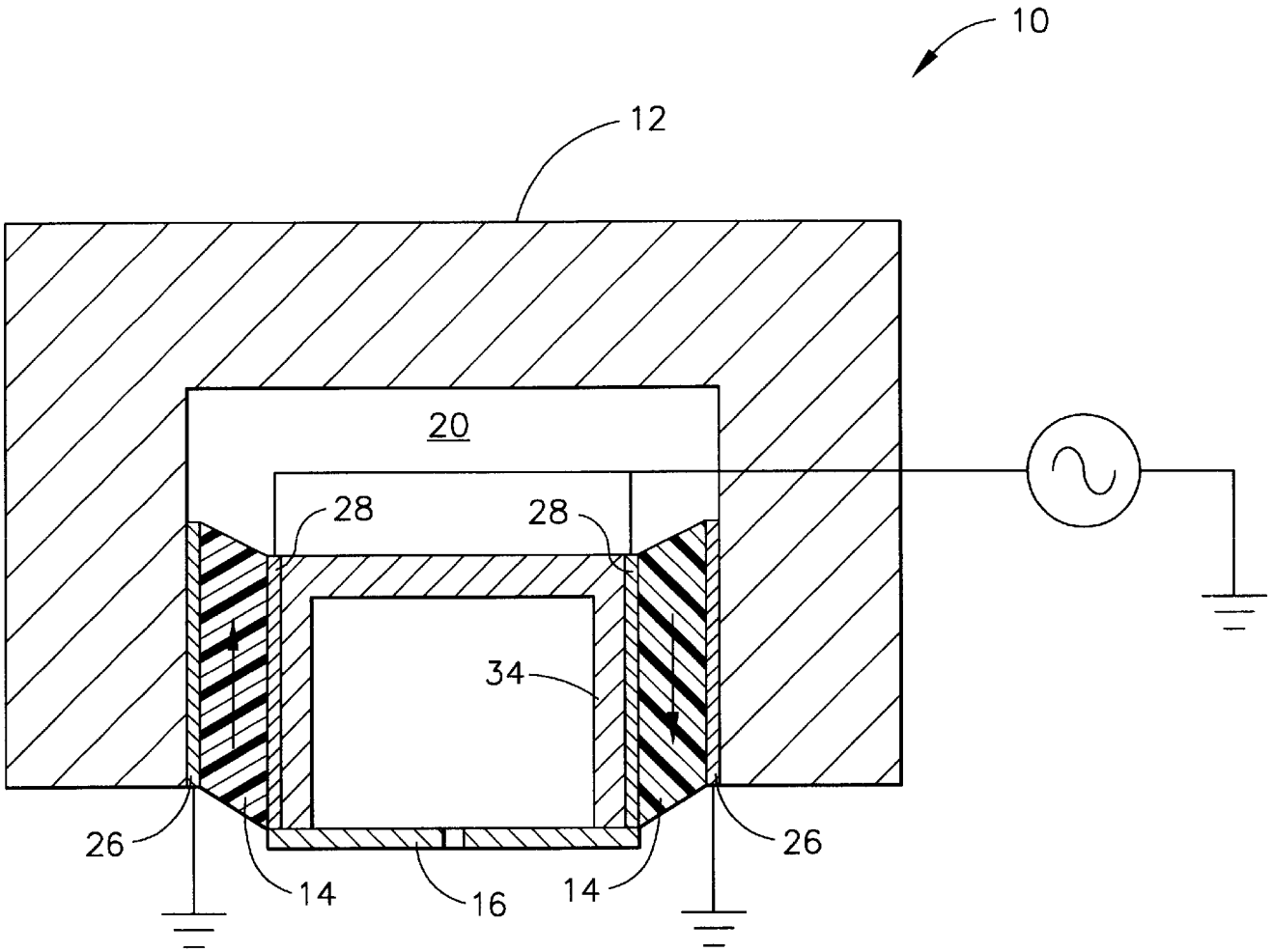

Referring now to FIG. 4, a light fluid manifold or inner housing 34 is attached to the inner face of the piezoelectrics 14, and piezoelectrics 26 are grounded. The orifice plate 16 is attached to the manifold 34. The outer electrode face of the piezoelectrics is attached to a structure which now serves only as a support, and it is no longer a fluid manifold. When the piezoelectrics 28 are electrically driven, the inner and outer electrode faces will tend to shift relative to each other. As the outer electrode face is attached to the rigid frame, which may be damped, the result is that the fluid manifold and the orifice plate are made to vibrate vertically as desired. With the piezoelectrics 14 bonded to housing 34, they shear and cause 34 to vibrate up and down, since structure 12 is too heavy to move. Preferably, the new smaller fluid manifold is light weight to minimize mass loading the shearing vibration action of the piezoelectric elements. It is further preferred that the new smaller fluid manifold be stiff or damped to prevent it from being excited to vibrate in one of its vibrational modes.

Figure 5:
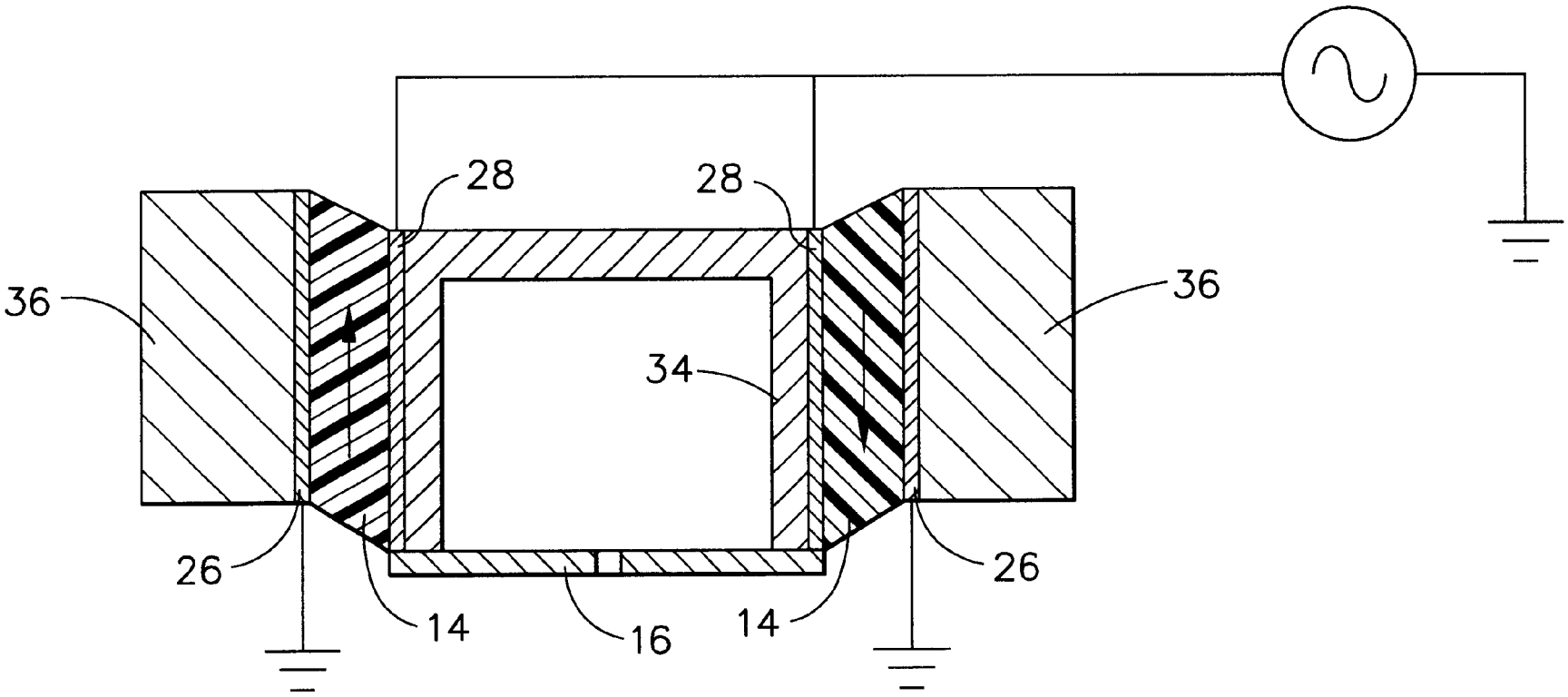

In FIG. 5, the vibration of the fluid manifold 34 and the orifice plate 16 do not depend on outer frame structure. Now there are independent reaction masses 36 attached to the outer faces of the piezoelectrics. As the piezoelectric transducers 14 are caused to shear (the outer electrodes 26 are driven by an oscillator and the electrodes 28 are grounded), the reaction masses will move in a direction opposite that of the fluid manifold 34 and the orifice plate 16. Unless acted on by some other force, the center of mass will remain fixed while the unit vibrates.

Figure 6:
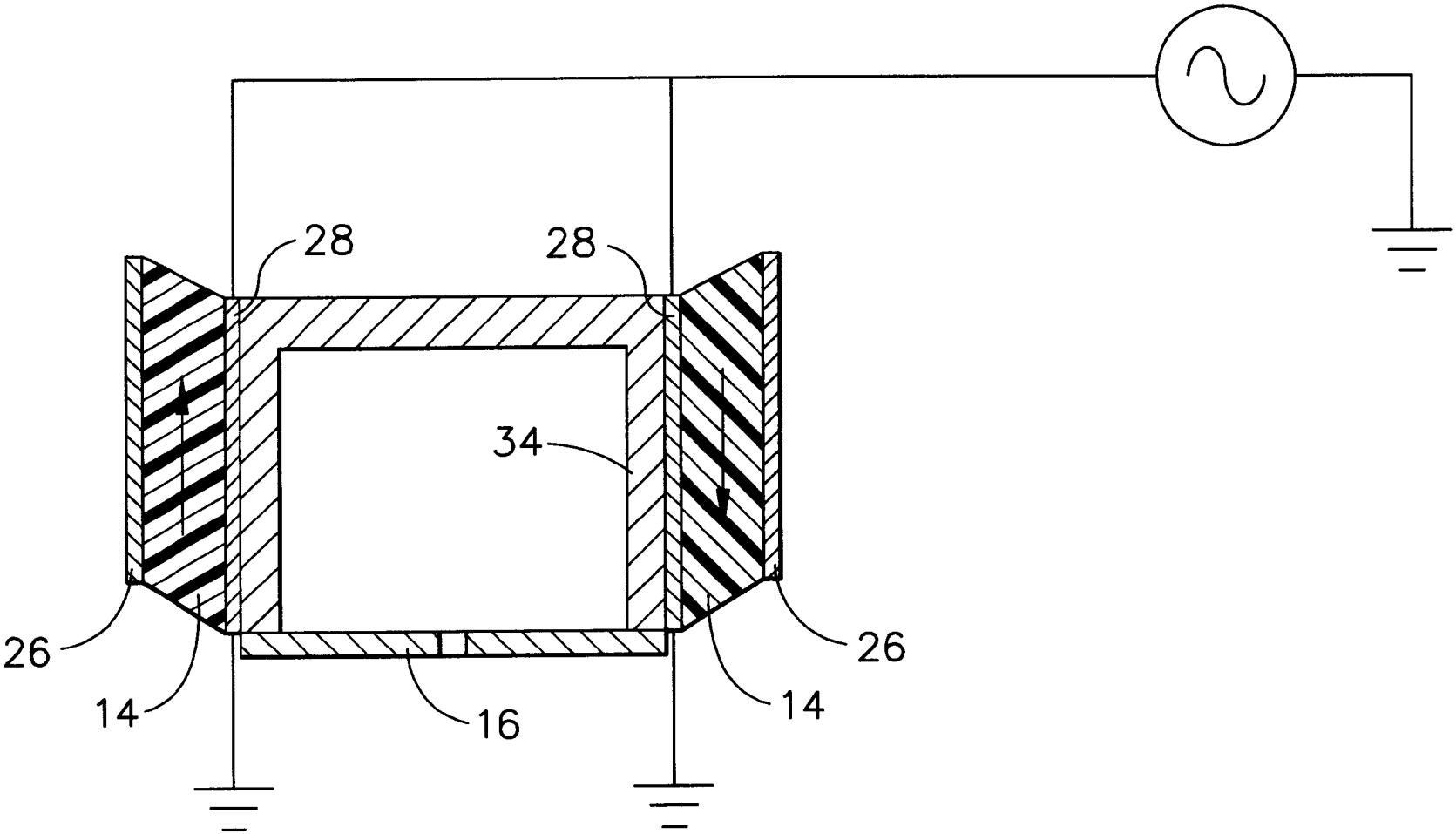

As the mass of the reaction masses is reduced, the relative amplitude of motion for the reaction masses and the fluid cavity will shift. This will reduce the efficiency of moving the fluid cavity. Even in the case where the reaction masses are removed, the fluid cavity will still be vibrated in the same manner, just at lower amplitude, as illustrated in FIG. 6. In FIG. 6, the reaction masses has been essentially shrunk to zero. The fluid manifold 34 moves to keep the center of mass fixed as the piezoelectric actuators 14 shear up and down.

Figure 7:
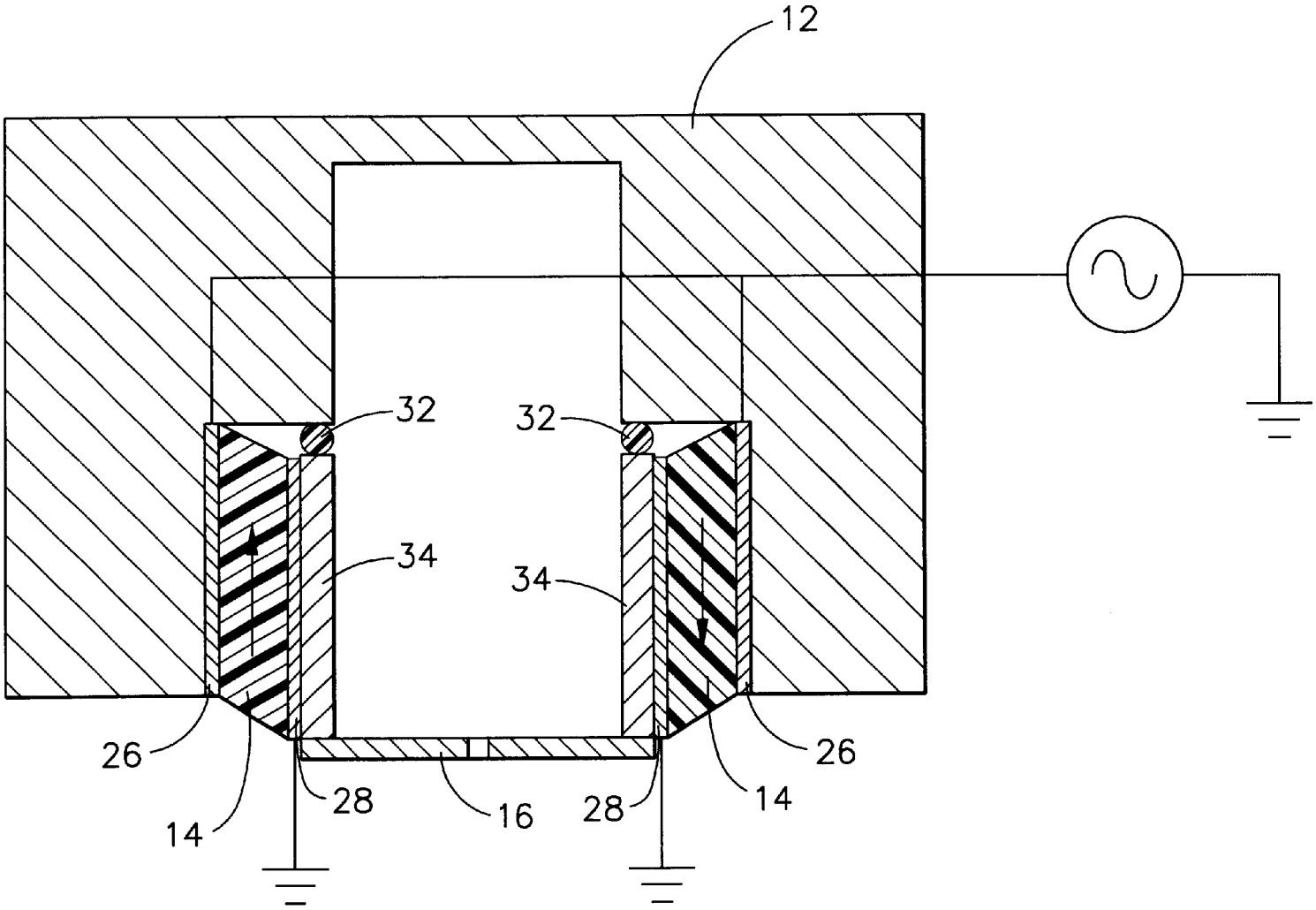

FIG. 7 illustrates a variation of the concept shown in FIG. 4. In FIG. 4, a fluid manifold 34 was mounted in an outer housing 12. In FIG. 7, the upper wall of the manifold 34 has been removed so that the fluid cavity extend from the manifold 34 up into the cavity of housing 12. Elastomeric (rubber) seals 32 contain the ink to these two areas, while allowing the lower portion to vibrate freely. The o-rings 32 seal between 34 and 12, so that as the manifold 34 vibrates, the crystals stay dry. That is, the piezoelectrics are prevented from contacting the fluid. It is noted that the mass of the vibrating fluid cavity could be reduced relative to the FIG. 4 construction.

Figure 8:
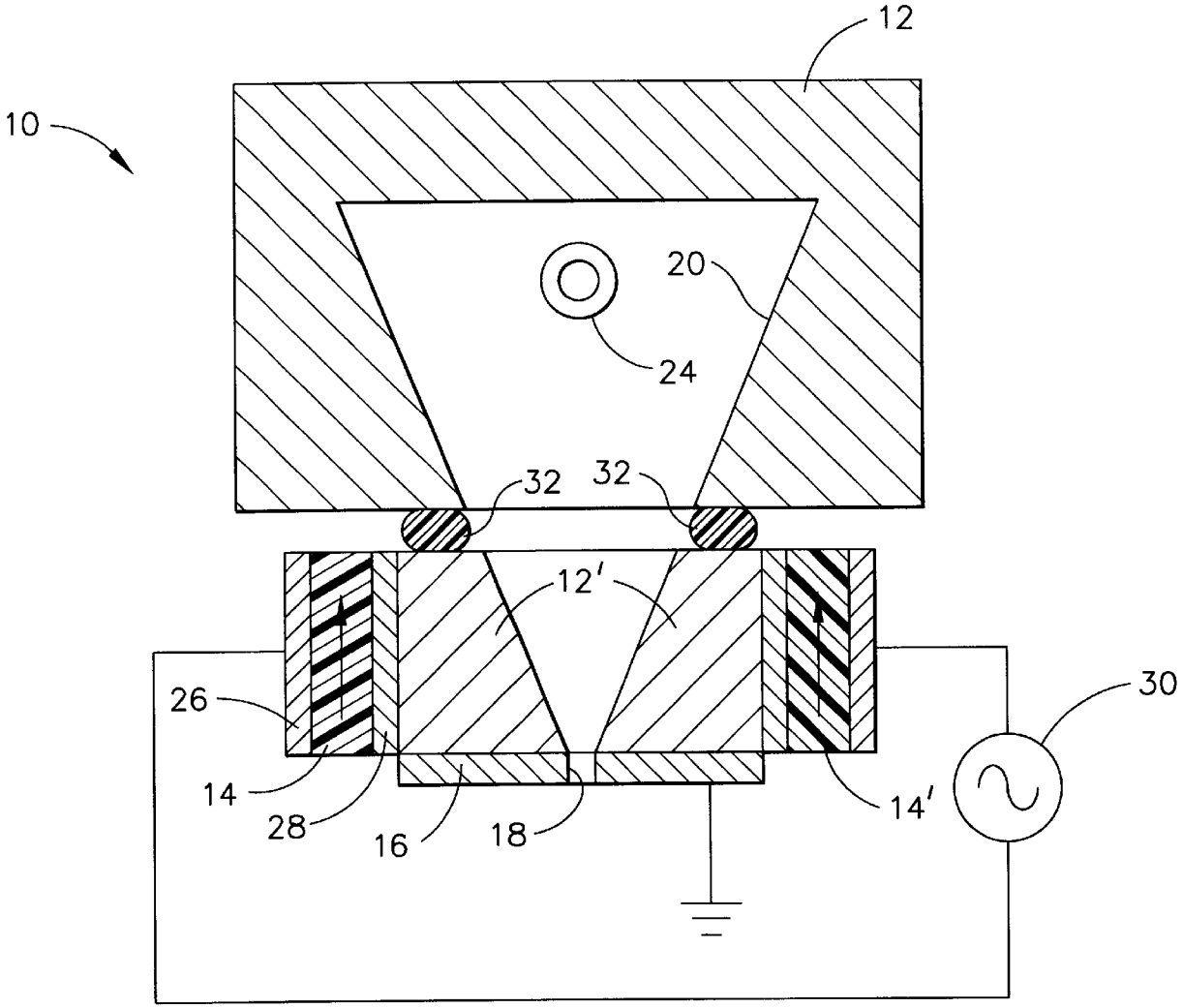

The design of FIG. 7 can be further altered by removing the rigid mount from the outer face of the piezoelectrics, as illustrated in FIG. 8. In FIG. 8, the lower part of the outer upper housing 12 is removed, and the crystals vibrate fluid cavity section 34 to maintain the center of mass. The manifold body 12 now includes a secondary lower portion 34 that is coupled to the main body 12 by resilient seal 32. The resilient seal may be, for example, epoxy. The orifice plate 16 is bonded to secondary body portion 34. Secondary body portion 34 is constructed to be of low mass so that it can be moved by piezoelectric transducer(s) 14 without exhibiting vibrational modes within the secondary body portion 34. Ink in the cavity 20 defined by manifold the upper body 12 and lower portion 34 does not come into contact with the electrodes 26, 28 on the piezoelectric transducers 14.

The poling axis and the electrode faces are also perpendicular to the plane of the orifice plate. Again, the fluid cavity ideally should be rigid and possibly damped so that it would be induced to vibrate without flexing. The orifice plate should also be quite stiff, the spacing between the piezoelectrics should be small, so that the orifice plate is not excited into flexure modes down the array. This design, therefore, makes use of piezoelectrics that have their poling axis and the electrode faces perpendicular to the orifice plate, and can be used to produce the desired vibration of the orifice plate without inducing vibrations down the array.

In all of these variations, the piezoelectric poling axis and the electrode faces are perpendicular to the plane of the orifice plate. The orifice plate or a fluid cavity holding the orifice plate are attached to one face of the piezoelectric. To the opposite face is attached either a rigid frame (which was the fluid cavity for some designs), or reaction masses, or nothing. The plate can be vibrated symmetrically along the two edges or one edge can be vibrated while the other is fixed.

By using fairly thick shear mode actuators, the stiffness of the actuators can approach that of the body to which it is attached. Such actuators have sufficient rigidity to maintain consistent vibrational amplitude across a broad frequency range. When used to vibrate a drop generator this can produce consistent stimulation amplitudes across a broad frequency range. It is no longer necessary to stimulate near the resonant frequency of the drop generator.

Industrial Applicability and Advantages

The present invention is useful in the field of ink jet printing, and has the advantage of providing a print head for a continuous ink jet printer which can be synchronously stimulated above 100 kHz. An additional advantage of the present invention is to provide a print head that exhibits reduced mode coupling during stimulation.

The invention has been described in detail with particular reference to certain preferred embodiments thereof, but it will be understood that modifications and variations can be effected within the spirit and scope of the invention.

What is claimed is:

1. A continuous ink jet print head, comprising:

an orifice plate defining an elongated array of ink jet orifices;

an ink manifold for supplying ink to the orifices in said orifice plate, said ink manifold defining a cavity;

at least one shear mode piezoelectric transducer means mechanically coupled to said orifice plate for vibrating said orifice plate approximately uniformly along a line of the array of ink jet orifices to achieve synchronous stimulation of uniform motion of said orifice plate, wherein said at least one piezoelectric transducer means are located inside said cavity, or outside said manifold; and a poling vector associated with the at least one piezoelectric transducer wherein the poling vector is oriented substantially perpendicular to a plane of the orifice plate.

2. A continuous ink jet print head as claimed in claim 1 further comprising at least a pair of electrode faces associated with each of the at least one piezoelectric transducers.

3. A continuous ink jet print head as claimed in claim 2 wherein the pair of electrode faces are oriented substantially perpendicular to a plane of the orifice plate.

4. A continuous ink jet print head as claimed in claim 1 wherein the ink manifold mechanically couples the at least one piezoelectric transducer to the orifice plate.

5. A continuous ink jet print head as claimed in claim 1 wherein the at least one piezoelectric transducer comprises piezoelectric transducers on both sides of the elongated array of ink jet orifices.

6. A continuous ink jet print head, comprising:

an orifice plate defining an elongated array of ink jet orifices;

an ink manifold for supplying ink to the orifices in said orifice plate, said ink manifold defining a cavity;

at least one shear mode piezoelectric transducer means mechanically coupled to said orifice plate for vibrating said orifice plate approximately uniformly along a line of the array of ink jet orifices to achieve synchronous stimulation of uniform motion of said orifice plate, wherein said at least one piezoelectric transducer means are located inside said cavity, or outside said manifold, and wherein the at least one piezoelectric transducer comprises piezoelectric transducers on both sides of the elongated array of ink jet orifices.

7. A continuous ink jet print head as claimed in claim 6 further comprising a poling vector associated with the at least one piezoelectric transducer, wherein the poling vector is oriented substantially perpendicular to a plane of the orifice plate.

* * * * *